US005285624A

United States Patent [19]

Stahlecker

[11] Patent Number: 5,285,624

[45] Date of Patent: Feb. 15, 1994

[54] ARRANGEMENT FOR PNEUMATIC FALSE-TWIST SPINNING

[75] Inventor: Fritz Stahlecker, Bad Überkingen, Fed. Rep. of Germany

[73] Assignee: Hans Stahlecker, Sussen, Fed. Rep. of Germany

[21] Appl. No.: 777,918

[22] Filed: Oct. 17, 1991

[30] Foreign Application Priority Data

Oct. 17, 1990 [DE] Fed. Rep. of Germany ..... 4032940

[51] Int. Cl.[5] ..... D01H 13/04

[52] U.S. Cl. ..... 57/328; 57/352

[58] Field of Search ..... 57/328, 352, 315

[56] References Cited

U.S. PATENT DOCUMENTS

| | | | |
|---|---|---|---|
| 4,387,487 | 6/1983 | Nakahara et al. | 57/328 X |
| 4,463,549 | 8/1984 | Kajita et al. | 57/328 |
| 4,509,321 | 4/1985 | Kajita et al. | 57/328 |
| 4,598,537 | 7/1986 | Kroupa et al. | 57/328 X |
| 4,676,062 | 6/1987 | Brockmanns et al. | 57/328 X |
| 4,942,731 | 7/1990 | Morihashi et al. | 57/328 |

FOREIGN PATENT DOCUMENTS

| | | | |
|---|---|---|---|
| 3714212 | 11/1988 | Fed. Rep. of Germany | 57/328 |
| 3842120 | 6/1989 | Fed. Rep. of Germany . | |
| 3901791 | 8/1989 | Fed. Rep. of Germany . | |
| 3933218 | 4/1991 | Fed. Rep. of Germany | 57/328 |
| 3939776 | 6/1991 | Fed. Rep. of Germany | 57/328 |

*Primary Examiner*—Joseph J. Hail, III

*Attorney, Agent, or Firm*—Evenson, McKeown, Edwards & Lenahan

[57] ABSTRACT

In the case of an arrangement for pneumatic false-twist spinning, it is provided that a sliver is divided in the area of the delivery roller pair of a drafting unit, is divided into two partial slivers. Edge fibers are spread away during and after the division. The divided slivers are then jointly or separately pneumatically false-twisted and are wound up as an individual yarn, as two separate yarns or as a double yarn.

20 Claims, 6 Drawing Sheets

ARRANGEMENT FOR PNEUMATIC FALSE-TWIST SPINNING

BACKGROUND AND SUMMARY OF THE INVENTION

The invention relates to an arrangement for pneumatic false-twist spinning having a drafting unit which comprises devices for dividing a sliver into two partial slivers and which is followed by a pneumatic false-twisting device.

In the case of a known arrangement of the initially mentioned type (German Patent Document DE-A 38 42 120 and corresponding U.S. Pat. No. 4,942,731 to Morihashi et al.), a drivable biconical wheel is arranged inside the drafting unit between the intake roller pair and the next roller pair, which, in the manner of a separating wedge, divides the entering sliver into two partial slivers. These slivers then travel separately through the apron guide and the delivery roller pair as well as through separate air nozzles of the false-twisting device. They are subsequently guided together in front of a common withdrawal device and, while they are disposed side-by-side, are wound onto a spool as a double yarn.

It is also known (German Patent Document DE-A 39 01 791) to divide the sliver fed by a drafting unit into two partial slivers which are each fed to a ring spindle. In the case of this construction, it is provided that the sliver is not divided into the two partial slivers until it has passed through the drafting unit, that is, at the pair of delivery rollers of the drafting unit. For this purpose, one of the two delivery rollers is constructed as a suction roller which is provided with two suction slots which diverge from the area of the nip line. These suction slots each taper in the yarn travelling direction in order to be provided with a certain bundling of the two partial slivers.

It is an object of the invention to improve an arrangement of the initially mentioned type in such a manner that a larger quantity of edge fibers are spread away which subsequently can be utilized as wind-around fibers and which provide the yarn with a more uniform appearance and/or an increased strength.

This object is achieved according to preferred embodiments of the invention in that a roller of the pair of delivery rollers of the drafting unit is constructed as a suction roller which forms two suction zones which divide the sliver behind the nip line into the partial slivers and spread edge fibers away from the partial slivers.

The invention is based on the recognition that, when the division into the two partial slivers does not start before the area of the nip line of the pair of delivery rollers, it is possible to spread away a larger quantity of edge fibers. However, for this purpose, care must be taken that the partial slivers are not bundled as in the case of the construction according to the German Patent Document DE-A 39 01 791 but that, on the contrary, edge fibers are intentionally spread away.

In order to carry out an intentional spreading-away of edge fibers, it is provided in a further development of the invention that the suction roller provided with a perforation has a suction insert which has two suction zones moving away from one another starting from the area of the nip line in the travelling direction of the yarn, the effective width of these suction zones increasing in the travelling direction of the yarn. It is particularly advantageous in this case for the two suction zones to each start as a suction slot which are in each case continued by two slots extending in parallel to one another. The slots, which each extend in parallel to one another, will then be situated next to the partial sliver so that edge fibers are spread away toward both sides and are held in this spread-away position.

In a further development of the invention, it is provided that a pressure roller is assigned to the suction roller and is arranged in the area of the ends of the suction zones. As a result, it is achieved that the false twist, which originates from the false-twisting device, is stopped in the area of the pressure roller so that it does not impair the spreading-away of edge fibers.

In a further development of the invention, it is provided that the false-twisting device for each of the partial slivers has at least one air nozzle. In a first embodiment, it is then provided that the air nozzles are followed by separate wind-up devices for each of the partial slivers. The partial slivers are therefore spun into respective separate yarns which are wound onto separate spools.

In a modified embodiment, it is provided that the air nozzles are followed by devices for the guiding-together of the spun partial slivers and by a common wind-up device. The spun partial slivers are then wound onto a common spool as a double yarn. In this case, it is expediently provided that the two partial slivers are not spun completely but are only prestrengthened. The spool package, which receives the double yarn, will then be fed to a twisting machine so that the final strength of the yarn is obtained by means of a twisting. In the case of this embodiment, it is advantageous for the devices for the guiding-together to form travelling paths of a different length for the two spun partial slivers. As a result, it is achieved that the two partial slivers with respect to their length are guided together again in an offset manner so that a doubling effect is obtained which compensates possible inaccuracies as a result of the sliver division.

In another embodiment of the invention, a false-twisting device is provided which both partial slivers have in common and which comprises at least one air nozzle. In this embodiment, a common yarn is then again spun from the two partial slivers. In this case, the division of the slivers results in the advantage that a significantly higher number of edge fibers were spread so that an improved winding-around and therefore a particularly firm yarn is achieved.

Other objects, advantages and novel features of the present invention will become apparent from the following detailed description of the invention when considered in conjunction with the accompanying drawings.

DETAILED DESCRIPTION OF THE DRAWINGS

Figure 1:
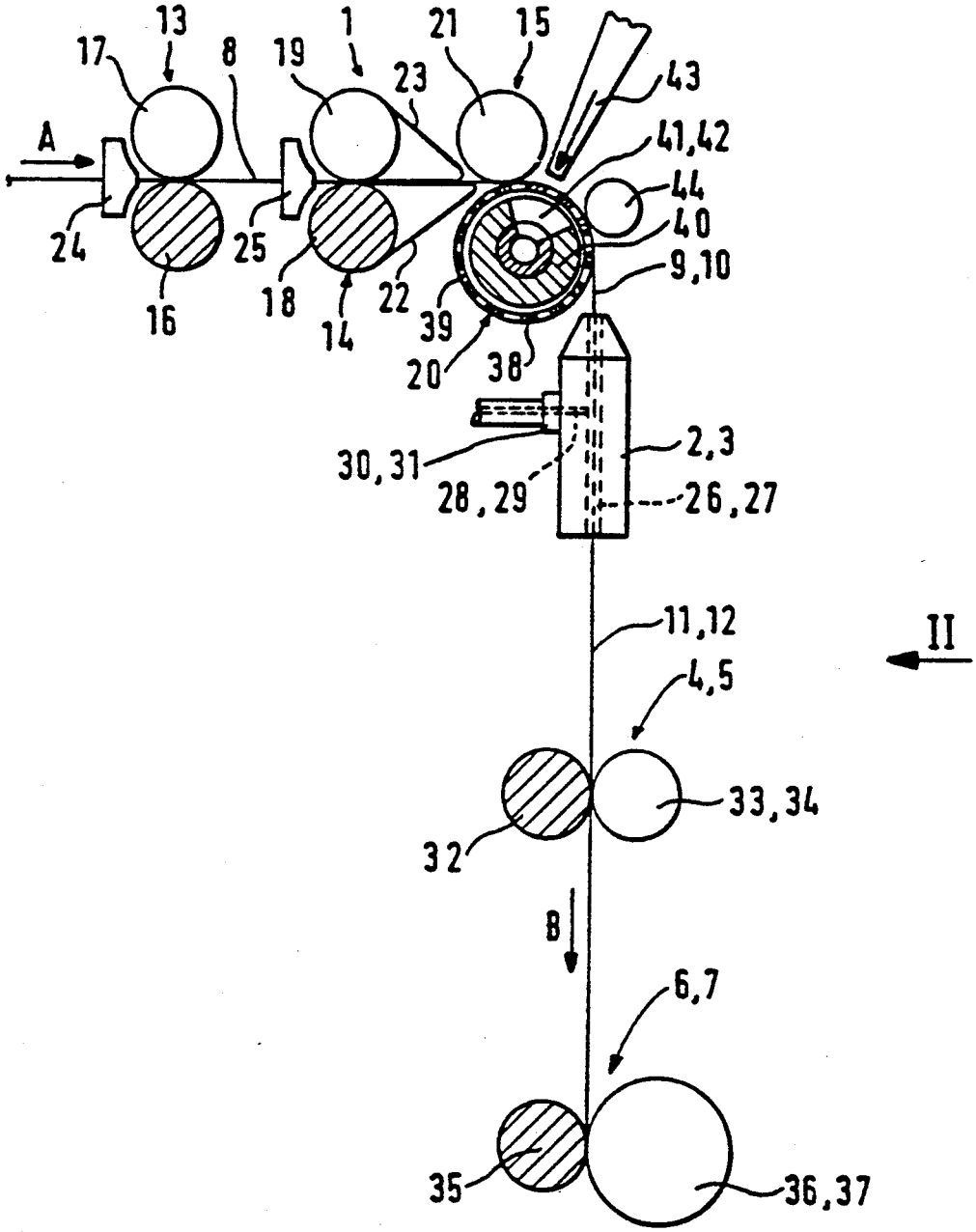
FIG. 1 is a schematic partially sectioned lateral view of an arrangement constructed according to an embodiment of the invention by means of which two threads are spun and are wound onto separate spools.
Figure 2:
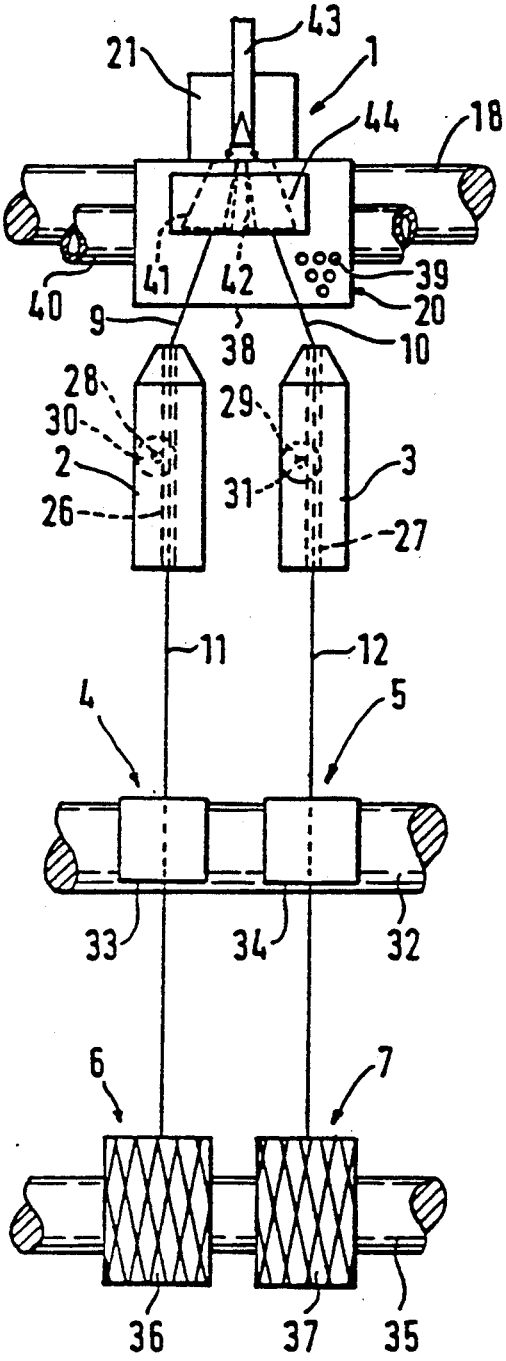
FIG. 2 is a view of the arrangement according to FIG. 1 taken in the direction of the arrow II of FIG. 1.

The unit illustrated in FIGS. 1 and 2 is a component of a spinning machine which, on at least one side of the machine, is equipped with a plurality of similar units. Each unit comprises a drafting unit 1, a following pneumatic false-twisting device 2, 3, two withdrawal devices 4, 5 and two wind-up devices 6, 7 which each wind a cross-wound package 36, 37. A sliver 8 which is taken out of a spinning can, for example, is fed to the drafting unit I in the direction of the arrow (A). The sliver 8 is divided into two partial slivers 9 and 10 which subsequently are spun into yarns 11, 12 which are withdrawn in the direction of the arrow (B).

As the drafting unit 1, a three-cylinder drafting unit is provided which has an intake roller pair 13, a central roller pair 14 and a delivery roller pair 15. The intake roller pair 13 comprises a drivable bottom cylinder 16 extending through in the longitudinal direction of the machine, and a pressure roller 17. In a corresponding manner, the central roller pair 14 is formed of a drivable bottom cylinder extending through in the longitudinal direction of the machine and of a pressure roller 19. The delivery roller pair 15 comprises a drivable roller 20 and a pressure roller 21 which is pressed against it. The roller 20, which is the bottom roller, is constructed as a suction roller. In the drafting zone between the central roller pair 14 and the delivery roller pair 15, an apron guide is disposed having a bottom apron 22 and a top apron 23. Sliver condensers 24, 25 are arranged in front of the intake roller pair 13 and the central roller pair 14.

As will be explained in the following, the division of the sliver 8 into the two partial slivers 9, 10 takes place in the area of the delivery roller pair 15. The partial slivers 9, 10 enter into the false-twisting devices 2, 3 which, in a known manner, are formed of one or two air nozzles arranged behind one another which each have a straight yarn duct 26, 27 into which at least one compressed-air nozzle 28, 29 leads tangentially. By way of compressed-air lines 30, 31, the compressed-air nozzles 28, 29 are connected to a compressed-air source.

The withdrawal devices 4, 5 are formed by a drivable withdrawal roller 32 extending through in the longitudinal direction of the machine, and of two pressure rollers 33, 34. The two wind-up devices 6, 7 are illustrated in a very simplified manner. They comprise a drivable winding roller 35, which extends through in the longitudinal direction of the machine and drives the spool packages 36, 37. In a manner not shown in detail, the spool packages 36, 37 are held in one or two pivotable spool frames. A cross-winding device is also arranged in front of each spool package 36, 37. Also, additional known elements are arranged in front of the wind-up devices 6, 7 which cause a compensation for the length changes of the yarn paths during the winding of the cross-wound packages.

The roller 20 is a hollow cylinder, the shell surface 38 of which is used as a guiding surface for two partial slivers 9, 10 which are formed from the sliver 8. The shell surface 38 is provided with a perforation 39. In the interior of the roller 20, a suction insert 40 is arranged which forms two suction slots 41, 42 aimed at the shell 38. The two suction slots 41, 42 start at the nip line of the delivery roller pair 15 and then diverge in the travelling direction of the yarn in a V-shape at an angle of approximately 30°. They end after an angle of approximately 90° over the circumference of the roller 20. The suction slots 41, 42 effectively widen in the traveling direction of the sliver.

By means of the suction slots 41, 42, which are closely adjacent to one another, or even merge into one another on the nip line of the delivery roller pair 15, the drafted sliver 8 is broken open and divided into the two partial slivers 9, 10 which then follow the suction slots 41, 42 on the shell surface 38 of the suction roller and move apart. For promoting the dividing operation, in the case of the embodiment according to FIG. 1 and 2, a blow nozzle 43 is provided in addition which is aimed at the area between the two suction slots 41, 42 behind the nip line of the delivery roller pair 15.

In the area of the end of the suction slots 41, 42, a pressure roller 44 rests against the roller 20 on the outside, this pressure roller 44 clamping the two partial slivers 9, 10 between itself and roller 20. As a result, the point can be precisely defined up to which the false twist can travel back which is provided to the slivers 9, 10 by the false-twisting devices 2, 3.

It is important that the suction slots 41, 42 do not have the effect of bundling the partial slivers 9, 10. On the contrary, it is to be achieved in the area of the suction slots 41, 42 that edge fibers are spread away from the partial slivers 9, 10 which subsequently form the wind-around fibers.

Figure 5:
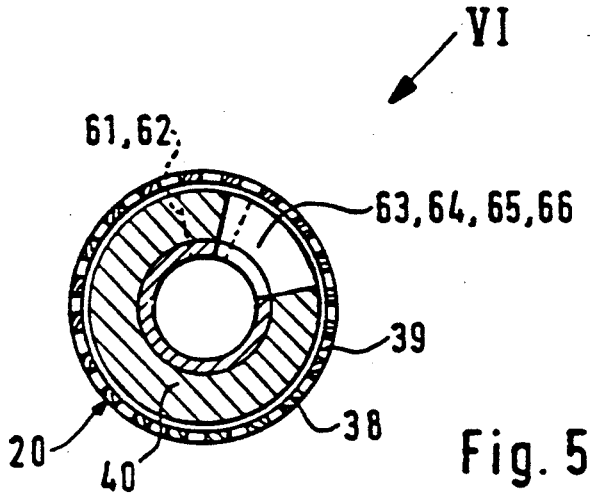
FIG. 5 is a slightly enlarged partial sectional view of a suction roller similar to the embodiment according to FIG. 1.

The effect of the spreading-away of the edge fibers in the area of the suction roller can be influenced by the air currents affecting the partial slivers 9, 10. In the embodiment according to FIGS. 5 and 6, it is provided that the suction insert 40 of the roller 20 constructed as a suction roller first has two V-shaped diverging suction slots 61, 62 which come very close to one another on the nip line of the pair of delivery rollers 15 or even merge into one another. After a relatively short path, for example, approximately 30°, the suction slots 61, 62 are continued by two suction slots 63, 64; 65, 66, which extend in parallel to one another and leave a closed web between one another. In the case of this embodiment, the partial slivers 9, 10 are guided essentially over the area of the closed web; that is, their core composite travels over this area. Toward both sides, the edge fibers can then be sucked off to the suction slots 63, 64; 65, 66.

Figure 6:
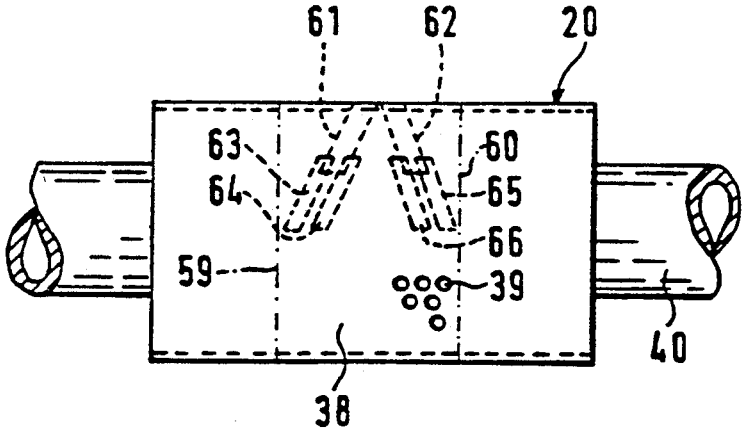
FIG. 6 is a view of the suction roller according to FIG. 5 in the direction of the arrow VI.

As shown in FIG. 6, the roller 20 is provided with perforations 39 only in the area of the suction slots 61 to 66. This area is marked by dash-dotted boundary lines 59, 60.

In the case of a modified embodiment, it is provided that the two false-twisting devices 2, 3 are turned in such a manner that they diverge in a V-shape; that is, that their yarn ducts 26, 27 extend essentially as a continuation of the direction which the partial slivers 9, 10 have on the roller 20. In this case, a yarn deflecting guide is then provided behind the false-twisting devices 2, 3 which deflects the spun yarns 11, 12 to the withdrawal devices 4, 5.

In the case of a further modification, it is provided that not the drivable bottom roller 20 of the delivery roller pair 15 is constructed as a suction roller but rather the non-drivable pressure roller 21 is so constructed as a suction roller. The drafting unit 1 is then arranged and aligned in such a manner that the division of the sliver 8 takes place on the pressure roller 21. The rollers must then correspondingly be arranged in such a manner that a guiding for the partial slivers 9, 10 takes place that is similar to that of FIGS. 1 and 2.

Figure 3:
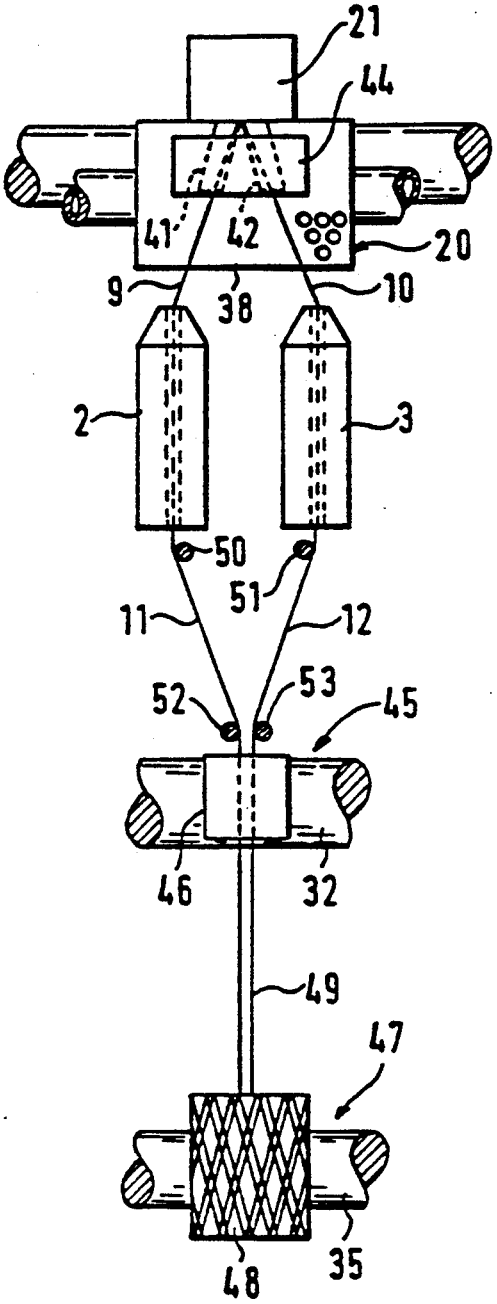
FIG. 3 is a view similar to FIG. 2, showing a modified arrangement in which the two spun yarns are wound onto a common spool as a double yarn.

The embodiment shown in FIG. 3 corresponds essentially to the embodiment according to FIG. 1 and 2; that is, up to the area behind the false-twisting devices 2, 3. Behind these false-twisting devices 2, 3, the spun yarns 11, 12 are guided together by means of yarn guides 50, 51, 52, 53 so that they are disposed side-by-side but do not touch. This double yarn 49 is then withdrawn by a common withdrawal device 45 and is wound by means of a winding device 47 to a cross-wound package 48 which receives the double yarn 49 side-by-side. This cross-wound package 48 is then used as a feeding package for a subsequent twisting operation. In this case, it is provided that the partial slivers 9, 10 are only spun into prestrengthened yarns 11, 12 which have only a relatively low strength. This may take place in that, for example, the pneumatic false-twisting devices 2, 3 are operated at a lower air pressure. The double yarn will then not receive its final strength before it is subsequently twisted.

Figure 7:
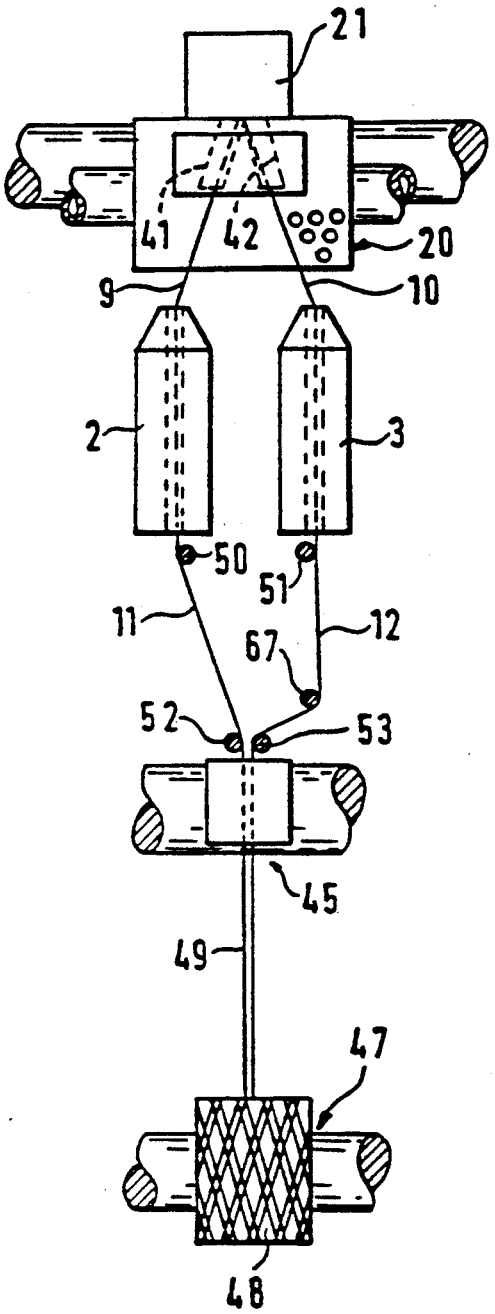
FIG. 7 is a view of a modified arrangement similar to FIG. 3 which has yarn travelling paths of different lengths for the two prestrengthened yarns produced from the partial slivers which are wound onto a joint spool as a double yarn.

A modification of the embodiment according to FIG. 3 is shown in FIG. 7. An additional yarn guide 67 is provided by means of which a longer yarn travelling path is provided for the yarn 12 before the two yarns 11, 12 are guided together to the double yarn 49. This has the result that a doubling effect is obtained. Inaccuracies which may possibly be caused by the division of the sliver 8 into the two partial slivers 9, 10 are thus largely compensated.

Figure 4:
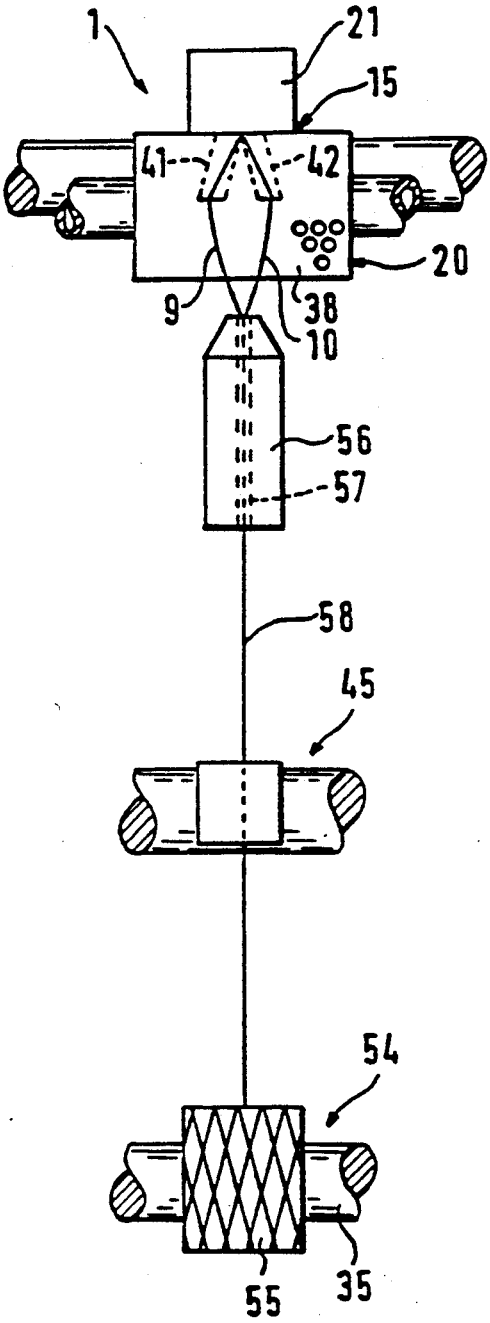
FIG. 4 is a view similar to FIG. 2, showing a further modified arrangement in which the two partial slivers are guided together again before reaching the false-twisting device.

In the embodiment according to FIG. 4, the drafting unit 1 is followed only by a common pneumatic false-twisting device 56 which comprises one or two air nozzles which are arranged behind one another and are provided with compressed air. The dividing of the slivers 8 behind the nip line of the delivery roller pair 15 only has the object of increasing the number of the spread-away edge fibers. However, the two partial slivers 9, 10 are subsequently guided together again. In the case of this embodiment, a pressure roller 44 is therefore not necessary because the provided false twist may easily travel back to the area of the nip line of the delivery roller pair 15. A particularly firm uniform yarn 58 is therefore obtained which is withdrawn by a withdrawal device 45 and is wound to a cross-wound package 55 by means of a wind-up device 54.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An arrangement for false-twist spinning comprising:

a drafting unit including a delivery roller pair at its downstream end, said delivery roller pair including a suction roller with two separate suction zones for dividing a sliver behind a nip line of the delivery roller pair into two separated partial slivers, a pair of pneumatic false-twisting devices disposed downstream of the drafting unit for applying false twist to the respective partial slivers, and edge fiber spreading structure in the form of widening of at least one of the suction zones in the yarn travelling direction for spreading edge fibers away from the respective at least one partial sliver while travelling through the delivery roller pair and before being subjected to ballooning between the delivery roller pair and the false-twisting devices, whereby the spread away fibers are wound around core sections of the at least one partial sliver when the false twist is opened up.

2. An arrangement according to claim 1, wherein the suction roller provided with a perforation has a suction insert which defines the two suction zones, said suction zones being configured such that starting from the area of the nip line, they move away from one another in the travelling direction of the yarn and their effective width increases in the travelling direction of the yarn.

3. An arrangement according to claim 2, wherein the two suction zones each start as a suction slot which is continued in each case by two slots which extend in parallel to one another.

4. An arrangement according to claim 3, wherein a pressure roller is assigned to the suction roller and is arranged in the area of the ends of the suction zones.

5. An arrangement according to claim 2, wherein a pressure roller is assigned to the suction roller and is arranged in the area of the ends of the suction zones.

6. An arrangement according to claim 1, wherein the false-twisting devices have at least one air nozzle for each of the partial slivers.

7. An arrangement according to claim 6, wherein the air nozzles for each of the partial slivers are followed by separate wind-up devices.

8. An arrangement according to claim 7, wherein the suction roller is provided with perforations and has a suction insert which defines the two suction zones, said suction zones being configured such that starting from the area of the nip line, they move away from one another in the travelling direction of the yarn and their effective width increases in the travelling direction of the yarn.

9. An arrangement according to claim 6, wherein the air nozzles are followed by guiding devices for the guiding-together of the spun partial slivers and by a common wind-up device.

10. An arrangement according to claim 9, wherein the guiding devices form travelling paths of different lengths for the two spun partial slivers.

11. An arrangement according to claim 10, wherein the suction roller is provided with perforations and has a suction insert which defines the two suction zones, said suction zones being configured such that starting from the area of the nip line, they move away from one another in the travelling direction of the yarn and their effective width increases in the travelling direction of the yarn.

12. An arrangement according to claim 9, wherein the suction roller is provided with perforations and has a suction insert which defines the two suction zones, said suction zones being configured such that starting from the area of the nip line, they move away from one another in the travelling direction of the yarn and their effective width increases in the travelling direction of the yarn.

13. A method of false-twist spinning yarn comprising:

drafting sliver in a drafting unit including a delivery roller pair at its downstream end, said delivery roller pair including a suction roller with two separate suction zones for dividing the sliver behind a nip line of the delivery roller pair into two separated partial slivers, false twisting the two partial slivers in a pair of pneumatic false-twisting devices disposed downstream of the drafting unit for applying false twist to the respective partial slivers, and spreading edge fibers away from the respective partial slivers while they are travelling through the deliver roller pair and before they are subjected to ballooning between the delivery roller pair and the false-twisting devices, said spreading edge fibers including passing the slivers over at least one of said suction zones with said at least one suction zone widening in the yarn travelling direction, whereby the spread away fibers are wound around core sections of the partial slivers when the false twist is opened up.

14. A method according to claim 13, wherein the suction roller has a single suction insert which defines the two suction zones, said suction zones being configured such that starting from the area of the nip line, they move away from one another in the travelling direction of the yarn, and wherein said spreading edge fibers includes passing the respective slivers over respective ones of said two suction zones with both of said suction zones widening in the yarn travelling direction.

15. A method according to claim 14, wherein the two suction zones each start as a suction slot which is continued in each case by two slots which extend in parallel to one another.

16. A method according to claim 14, comprising assigning a pressure roller to the suction roller in the area of the ends of the suction zones.

17. A method according to claim 14, wherein the false-twisting includes passing each of the partial slivers through at least one air nozzle.

18. A method according to claim 17, comprising winding the partial slivers at separate wind-up devices disposed downstream of the at least one air nozzle.

19. A method according to claim 17, comprising guiding-together of the spun partial slivers by a common wind-up device.

20. A method according to claim 19, wherein the guiding include forming travelling paths of different lengths for the two spun partial slivers.

* * * * *